US009772573B2

(12) United States Patent
Sakamoto

(10) Patent No.: US 9,772,573 B2
(45) **Date of Patent: *Sep. 26, 2017**

(54) TONER AND METHOD OF MANUFACTURING THE SAME

(71) Applicant: KYOCERA Document Solutions Inc., Osaka (JP)

(72) Inventor: Noriaki Sakamoto, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 44 days.

This patent is subject to a terminal disclaimer.

(21) Appl. No.: 14/598,497

(22) Filed: Jan. 16, 2015

(65) Prior Publication Data

US 2015/0212438 A1 Jul. 30, 2015

(30) Foreign Application Priority Data

Jan. 27, 2014 (JP) ..... 2014-012345

(51) Int. Cl.
*G03G 9/093* (2006.01)

(52) U.S. Cl.
CPC ..... *G03G 9/09314* (2013.01); *G03G 9/09321* (2013.01); *G03G 9/09357* (2013.01); *G03G 9/09371* (2013.01); *G03G 9/09392* (2013.01)

(58) Field of Classification Search
CPC ..... G03G 9/06; G03G 9/0812; G03G 9/0825
See application file for complete search history.

(56) References Cited

U.S. PATENT DOCUMENTS

| | | | | |
|---|---|---|---|---|
| 4,950,573 | A | 8/1990 | Yamaguchi et al. | |
| 5,541,031 | A | 7/1996 | Yamashita et al. | |
| 5,576,393 | A | 11/1996 | Yamashita et al. | |
| 9,034,550 | B2 | 5/2015 | Mizoguchi et al. | |
| 2008/0166156 | A1 | 7/2008 | Kawase | |
| 2013/0236828 | A1 | 9/2013 | Mizoguchi et al. | |
| 2015/0212439 | A1* | 7/2015 | Sakamoto | G03G 9/09314 430/108.22 |

FOREIGN PATENT DOCUMENTS

| | | | |
|---|---|---|---|
| JP | S63-131149 | A | 6/1988 |
| JP | H01-257856 | A | 10/1989 |

(Continued)

OTHER PUBLICATIONS

Translation of JP 2010-191115.*

(Continued)

*Primary Examiner* — Peter Vajda
(74) *Attorney, Agent, or Firm* — Studebaker & Brackett PC

(57) ABSTRACT

A toner includes a plurality of toner particles each having a core and a shell layer residing on a surface of the core. Each of the toner particles has a distribution of surface potential, as measured by a scanning probe microscope with respect to a 1 $\mu m^2$ region of the toner particle in a state where no external additive adheres thereto, satisfying that the surface potential is at least $V_{min}+\Delta V\times 0.4$ in at least 70% and no greater than 95% of the 1 $\mu m^2$ region, where $\Delta V$ denotes a potential difference calculated by subtracting a minimum surface potential $V_{min}$ of the 1 $\mu m^2$ region from a maximum surface potential $V_{max}$ of the 1 $\mu m^2$ region.

16 Claims, 7 Drawing Sheets

(56) References Cited

FOREIGN PATENT DOCUMENTS

| | | | | | |
|---|---|---|---|---|---|
| JP | H06-214422 | A | | 8/1994 | |
| JP | H11-095478 | A | | 4/1999 | |
| JP | 2000-279878 | A | | 10/2000 | |
| JP | 2006-163149 | A | | 6/2006 | |
| JP | 2008-191639 | A | | 8/2008 | |
| JP | 2010-091717 | A | | 4/2010 | |
| JP | 2010-191115 | | * | 9/2010 | ..... G03G 9/08 |
| JP | 2010-191115 | A | | 9/2010 | |
| JP | 2012-128404 | A | | 7/2012 | |

OTHER PUBLICATIONS

An Office Action; "Notification of Reasons for Refusal," issued by the Japanese Patent Office dated Sep. 6, 2016, which corresponds to Japanese Patent Application No. 2014-012345 and is related to U.S. Appl. No. 14/598,497.

* cited by examiner

TONER AND METHOD OF MANUFACTURING THE SAME

INCORPORATION BY REFERENCE

The present application claims priority under 35 U.S.C. §119 to Japanese Patent Application No. 2014-012345, filed Jan. 27, 2014. The contents of this application are incorporated herein by reference in their entirety.

BACKGROUND

The present disclosure relates to a toner and a method of manufacturing the toner, and in particular to a capsule toner and a method of manufacturing the capsule toner.

In one known example of a toner, the electric potential on any surface of a toner particle changes before and after contact charging, by more than 1,000 mV either negatively or positively. The surface potential is measured by using a scanning probe microscope set in a surface potential measurement mode.

SUMMARY

A toner according to the present disclosure includes a plurality of toner particles each of which includes a core and a shell layer residing on a surface of the core. Each of the toner particles has a distribution of surface potential, as measured by a scanning probe microscope with respect to a 1 $\mu m^2$ region of the toner particle in a state where no external additive adheres thereto, satisfying that the surface potential is at least $V_{min}+\Delta V\times 0.4$ in at least 70% and no greater than 95% of the 1 $\mu m^2$ region. Here, $\Delta V$ denotes a potential difference calculated by subtracting a minimum surface potential $V_{min}$ of the 1 $\mu m^2$ region from a maximum surface potential $V_{max}$ of the 1 $\mu m^2$ region.

A method of manufacturing a toner according to the present disclosure involves: forming cores; causing a preliminary external additive to adhere to a surface of the cores; forming, after the preliminary external additive is caused to adhere, shell layers on the surface of the respective cores; and removing, after the shell layers are formed, the preliminary external additive from the surface of the cores. In the causing adhesion of the preliminary external additive, the preliminary external additive having a number average primary particle diameter of at least 200 nm and no greater than 600 nm is caused to adhere in an amount of at least 2.0 parts by mass and no greater than 9.0 parts by mass relative to 100 parts by mass of the cores.

DETAILED DESCRIPTION

An embodiment of the present disclosure will be described below.

A toner according to the present embodiment is a capsule toner for developing an electrostatic charge image. For example, the toner according to the present embodiment is appropriately usable as a positively chargeable toner for developing an electrostatic charge image. The toner according to the present embodiment is a powder formed from a large number of particles (hereinafter, referred to as toner particles). The toner may be used as one-component developer. Alternatively, the toner may be mixed with a carrier by using a mixer (for example, ball mill) to prepare a two-component developer. The toner according to the present embodiment is usable in an electrophotographic apparatus (an image forming apparatus), for example.

The following explains an example of a method of forming an image by an electrophotographic apparatus. First, based on image data, an electrostatic charge image is formed on a photosensitive member. Next, the electrostatic charge image thus formed is developed with a developer containing a toner. In the developing process, the electrically charged toner is caused to adhere to the electrostatic charge image. The toner (toner image) is transferred onto a transfer belt and is subsequently transferred from the transfer belt onto a recording medium (for example, paper). Then, the toner is fixed to the recording medium by heating. Through the above, an image is formed on the recording medium. A full-color image can be formed through superposition of toner images of four different colors, namely black, yellow, magenta, and cyan colors, for example.

Figure 1:
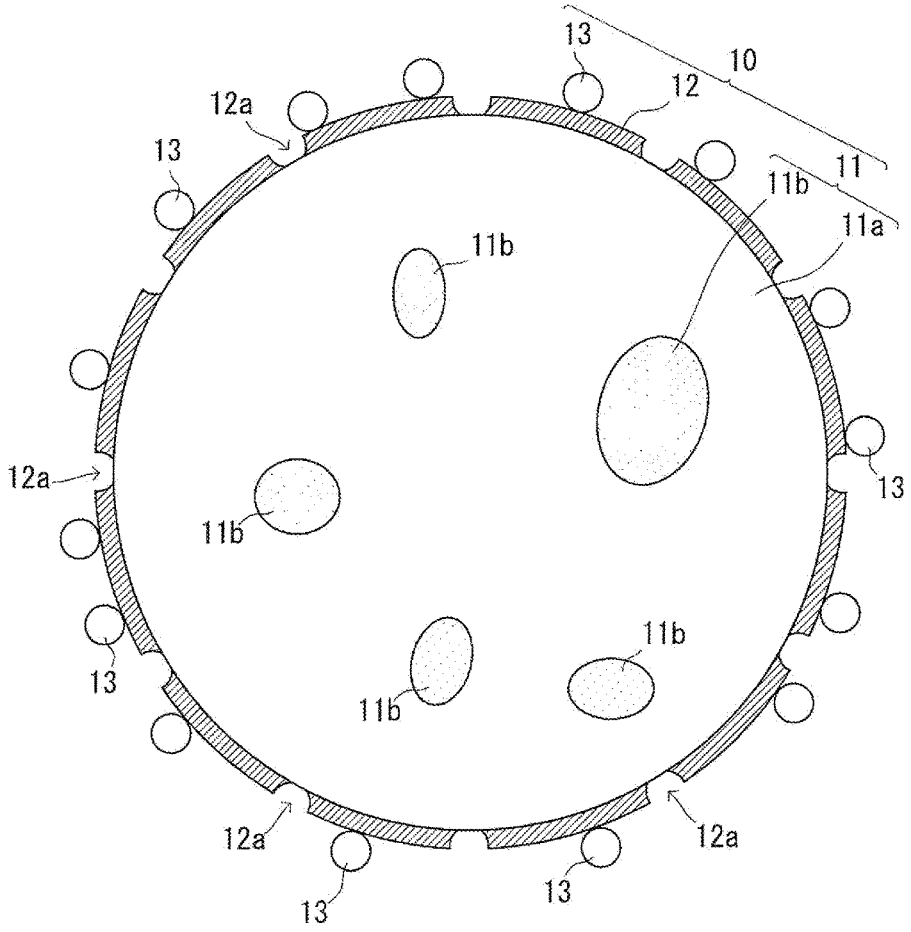
FIG. 1 shows one of toner particles included in a toner according to an embodiment of the present disclosure.

The following explains configuration of the toner (in particular, of the toner particles) according to the present embodiment with reference to FIG. 1. FIG. 1 shows one of toner particles 10 included in the toner according to the present embodiment.

As illustrated in FIG. 1, the toner particle 10 includes a core 11, a shell layer 12 (capsule layer) residing on the surface of the core 11, and an external additive 13.

The core 11 contains a binder resin 11*a* and one or more internal additives 11*b* (for example, a colorant and/or a releasing agent). The core 11 is covered by the shell layer 12. An external additive 13 adheres to the surface of the shell layer 12. In the following explanation, toner particles prior to the adhesion of the external additive are referred to as toner mother particles. In addition, toner particles from which the external additive adhering thereto is removed are also referred to as toner mother particles. A material for forming the shell layers are referred to as a shell material.

The toner particle 10 may be without the internal additives 11*b* or the external additive 13 if unnecessary. Also, a plurality of shell layers 12 may be stacked on the surface of the core 11.

Figure 2A:
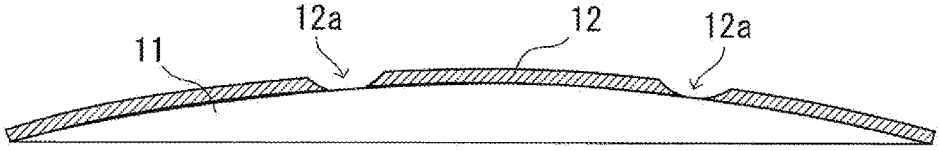
FIG. 2A is a cross-sectional view showing part of the toner particle shown in FIG. 1.
Figure 2B:
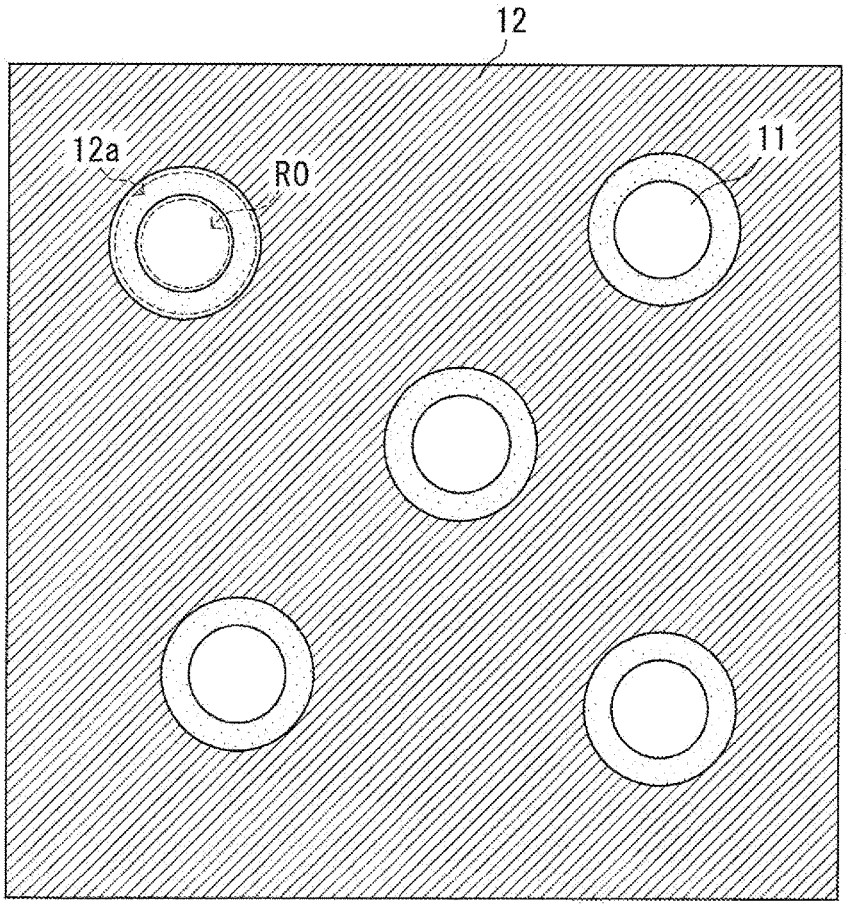
FIG. 2B is a plan view showing part of the toner particle shown in FIG. 1.
Figure 3:
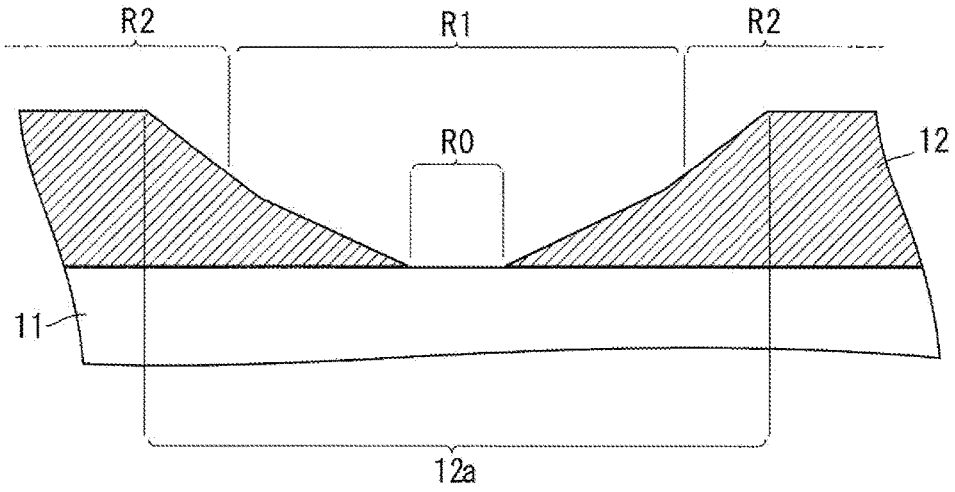
FIG. 3 is an enlarged cross-sectional view showing a cavity in a surface of the toner particle shown in FIG. 1.

With reference to FIGS. 2A, 2B, and 3 in addition to FIG. 1, the following explains the surface configuration of the toner particle 10, the method of determining the surface potential distribution, and the surface potential distribution of the toner particle 10. FIG. 2A is a cross-sectional view showing part of the toner particle 10. FIG. 2B is a plan view showing part of the toner particle 10. FIG. 3 is an enlarged cross-sectional view of a cavity 12*a*.

(Surface Configuration)

The shell layer 12 has a plurality of cavities 12*a*. Each cavity 12*a* extends through the shell layer 12, thereby exposing the core 11. In the following explanation, a region where the core 11 is exposed is referred to as a region R0 (See FIG. 3). Whether or not the core 11 has a shell layer 12 on the surface thereof is checked by, for example, separating the shell layer 12 from the core 11 through the use of a solvent that selectively dissolves the core 11 from among the core 11 and the shell layer 12 (without dissolving the shell layer 12). Note that the cavities 12*a* may not necessarily extend through the shell layer 12 (not necessarily expose the core 11).

(Determination of Surface Potential Distribution)

The surface potential distribution of the toner particle 10 (toner mother particle) is measured in the state where the external additive 13 does not adhere to the toner particle 10, by using a scanning probe microscope (SPM). The scanning probe microscope may be a Kelvin force microscopy (KFM), for example, and the surface potential distribution of the toner mother particle is measured by using the Kelvin method, for example. The surface potential distribution of the toner mother particle is measured on each of a plurality of regions having an area of 1 $\mu m^2$ (1 $\mu m \times 1$ $\mu m$) as shown in FIG. 2B, for example. The surface potential distribution may be measured prior to the adhesion of the external additive 13 to the shell layer 12 or after the removal of the external additive 13 from the shell layer 12. For example, the external additive 13 may be removed from the shell layer 12 by dissolving the external additive 13 with an alkaline solution (for example, aqueous sodium hydroxide solution). In another example, the external additive 13 may be removed from the shell layer 12 by using an ultrasonic cleaner.

The following explains one example of the method of removing the external additive 13 from the shell layers 12 by using an ultrasonic cleaner. First, the toner particles 10 are dispersed in ethanol or an aqueous surfactant solution by using an ultrasonic cleaner. The ultrasonic vibrations separate the external additive 13 from the toner mother particles. Subsequently, the dispersion is subjected to suction filtration through a filter having a pore size of 5 $\mu m$. As a result, particles of the external additive 13 pass through the filter, whereas the toner mother particles remain on the filter. Subsequently, the toner mother particles are collected and dried. Then, the surface of the toner mother particles is observed under an electron microscope. If the external additive 13 is not sufficiently removed, the above processes of dispersion, filtration, and drying are repeated until the external additive 13 are sufficiently removed.

To measure the surface potential distribution of a toner mother particle, a scanning probe microscope is used to scan a 1 $\mu m^2$ region (of the surface of the toner mother particle) to successively measure the surface potential on the substantially entire 1 $\mu m^2$ region. In the following explanation, the lowest surface potential within the 1 $\mu m^2$ region is referred to as the minimum surface potential Vmin, whereas the highest surface potential within the 1 $\mu m^2$ region is referred to as the maximum surface potential Vmax. In addition, the potential difference calculated by subtracting the minimum surface potential Vmin from the maximum surface potential Vmax is referred to as the potential difference $\Delta V$.

(Surface Potential Distribution of Toner Particle)

The toner contained in the two-component developer is charged by the friction between the toner and the carrier. For example, when the shell layers 12 are cationic, the friction between the shell layers 12 and the carrier charges the shell layers 12 to a positive charge. When the shell material is cationic and the cores 11 are anionic, the cationic shell material can be electrically attracted to the surface of the cores 11 in the formation of the shell layers 12. More specifically, for example, the shell material which is positively charged in an aqueous medium is attracted toward the cores 11 which are negatively charged in the aqueous medium, forming the shell layers 12 on the surface of the cores 11 through in-situ polymerization, for example. As a result of the shell material being attracted toward the cores 11, uniform shell layers 12 can be readily formed on the surface of the cores 11, without the use of a dispersant in order to highly disperse the cores 11 in the aqueous medium.

When the toner has the positively chargeable shell layers 12, the surface potential of each toner particle 10 tends to be higher with an increasing thickness of the shell layer 12. Therefore, the minimum surface potential Vmin is often the surface potential measured in a region R0 (where the core 11 is exposed through a cavity 12*a*). In addition, the maximum surface potential Vmax is often the surface potential measured in a region where the shell layer 12 is thickest in the entire surface of the toner particle 10 (where none of the cavities 12*a* is present).

The 1 $\mu m^2$ region shown in FIG. 3 is divided into: a region R1 where the surface potential is less than $Vmin+\Delta V \times 0.4$; and a region R2 where the surface potential is at least $Vmin+\Delta V \times 0.4$. A region where one cavity 12*a* is present may cover both a region R1 and a region R2. In one example, the minimum surface potential Vmin is 200 mV, whereas the maximum surface potential Vmax is 300 mV. The potential difference $\Delta V$ in this example is therefore 100 mV (=300 mV−200 mV). Within the 1 $\mu m^2$ region, a region having the surface potential of at least 240 mV (=200 mV+100 mV×0.4) corresponds to a region R2.

In each toner particle 10 according to the present embodiment, at least 70% and no greater than 95% by area ratio of any 1 $\mu m^2$ region corresponds to a region R2. The toner particles 10 having such a surface potential distribution (the toner particles 10 according to the present embodiment) are each assumed to have an appropriate number of cavities 12*a*, ensuring excellent chargeability (especially uniform surface potential). The amount of charge on the toner particles 10 (absolute value of the surface potential) can be adjusted by changing the shell material used.

The cores 11 being aniconic is indicated by that the cores 11 have a negative zeta potential (i.e., less than 0 V) when measured in an aqueous medium adjusted to pH 4 (in the following explanation, the aforementioned zeta potential is referred to simply as a zeta potential at pH 4). In order to increase the bonding strength between the cores 11 and the shell layers 12, the zeta potential of the cores 11 at pH 4 is preferably less than 0 V and the zeta potential of the toner particles 10 at pH 4 is preferably higher than 0 V. Note that in the present embodiment, pH 4 is equivalent to the pH of the aqueous medium during formation of the shell layers 12.

Examples of methods for measuring the zeta potential include an electrophoresis method, an ultrasonic method, and an electric sonic amplitude (ESA) method.

The electrophoresis involves applying an electrical field to a dispersion of particles, causing electrical migration of charged particles in the dispersion, and measuring the zeta potential based on the migration speed. An example of the electrophoresis method is laser Doppler electrophoresis in which migrating particles are irradiated with laser light and the migration speed of the particles is calculated from an amount of Doppler shift of scattered light that is obtained. The laser Doppler electrophoresis is advantageous in that: the particle concentration in the dispersion needs not be high; the number of parameters necessary for calculating the zeta potential is not large; and the speed of electrophoretic migration is detected with high sensitivity.

The ultrasonic method involves irradiating a dispersion of particles with ultrasonic waves, causing the electrically charged particles in the dispersion to vibrate, and measuring the zeta potential based on an electric potential difference that arises due to the vibrations.

The ESA method involves applying a high frequency voltage to a dispersion of particles, causing the electrically charged particles in the dispersion to vibrate and generate ultrasonic waves. The zeta potential is then calculated from magnitude (intensity) of the ultrasonic waves.

The ultrasonic method and ESA method are advantageous in that the zeta potential can be measured with high sensitivity even when the concentration of the particles in the dispersion is high (for example, exceeding 20% by mass).

With reference mainly to FIG. 1, the following sequentially explains the cores 11 (binder resin 11*a* and internal additives 11*b*), the shell layers 12, and the external additive 13. Note that the term (meth)acrylic may be used as a generic term for both acrylic and methacrylic.

[Cores]

The cores 11 contain the binder resin 11*a*. The cores 11 may additionally contain internal additives 11*b* (a colorant and a releasing agent). Yet, the cores 11 may be without either or both of a colorant and a releasing agent and may contain at least either a charge control agent or a magnetic powder.

[Binder Resin (Cores)]

The binder resin 11*a* constitutes a large proportion (for example, at least 85% by mass) of the component of the cores 11. Therefore, the polarity of the binder resin 11*a* has a significant influence on the overall polarity of the cores 11. When for example the binder resin 11*a* has an ester group, a hydroxyl group, an ether group, an acid group, or a methyl group, the cores 11 have a strong tendency to be anionic. On the other hand, when for example the binder resin 11*a* has an amino group, an amine, or an amide group, the cores 11 have a strong tendency to be cationic.

For the binder resin 11*a* to be strongly anionic, the hydroxyl value (measurement method: JIS K-0070) and the acid value (measurement method: JIS K-0070) of the binder resin 11*a* are each preferably at least 10 mg KOH/g and more preferably at least 20 mg KOH/g.

The glass transition point Tg of the binder resin 11*a* is preferably no greater than the curing initiation temperature of the shell material. With the binder resin 11*a* having such a Tg, the toner can be easily fixed at low temperatures even during high-speed fixing. The curing initiation temperature of thermosetting resins (in particular, a melamine-based resin) is typically on the order of 55° C. Tg of the binder resin 11*a* is preferably at least 20° C., more preferably at least 30° C. and no greater than 55° C., and particularly preferably at least 30° C. and no greater than 50° C. With the binder resin 11*a* having a Tg of at least 20° C., the cores 11 are less prone to aggregate during the formation of the shell layers 12.

The softening point Tm of the binder resin 11*a* is preferably no greater than 100° C., and more preferably no greater than 95° C. With the binder resin 11*a* having a Tm of no greater than 100° C. (more preferably no greater than 95° C.), the toner can be easily fixed at low temperatures even during high-speed fixing. Furthermore, with the binder resin 11*a* having Tm of no greater than 100° C. (preferably no greater than 95° C.), the cores 11 are partially softened during a curing reaction of the shell layers 12 caused in the formation of the shell layers 12 on the surface of the cores 11 in the aqueous medium. Consequently, the cores 11 tend to have a spherical shape due to surface tension. Note that Tm of the binder resin 11*a* may be adjusted by combining a plurality of resins each having a different Tm.

Figure 4:
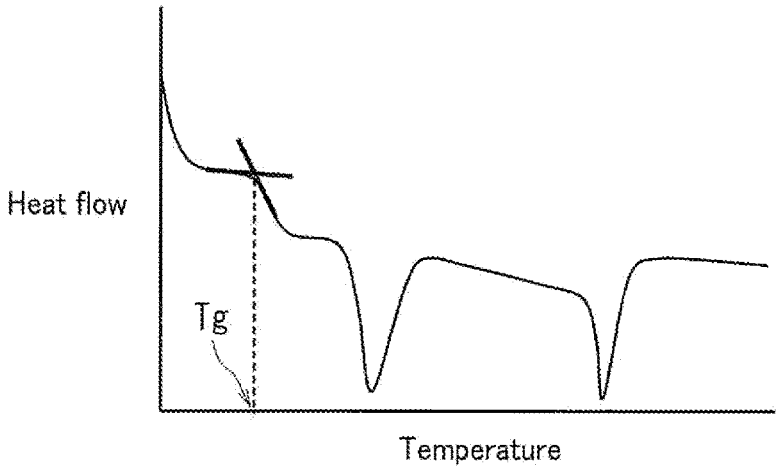
FIG. 4 illustrates a method of reading a glass transition point from a heat absorption curve.

The following explains a method of reading Tg of the binder resin 11*a* from a heat absorption curve with reference mainly to FIG. 4. FIG. 4 is a graph of an example of the heat absorption curve.

The glass transition point Tg of the binder resin 11*a* can be measured according to the following method. The heat absorption curve of the binder resin 11*a* can be obtained by using a differential scanning calorimeter (for example, DSC-6220, product of Seiko Instruments Inc.). For example, the obtained heat absorption curve is as shown in FIG. 4. The glass transition point Tg of the binder resin 11*a* can be determined from the heat absorption curve obtained (more specifically, from a point of change in the specific heat of the binder resin 11*a*).

Figure 5:
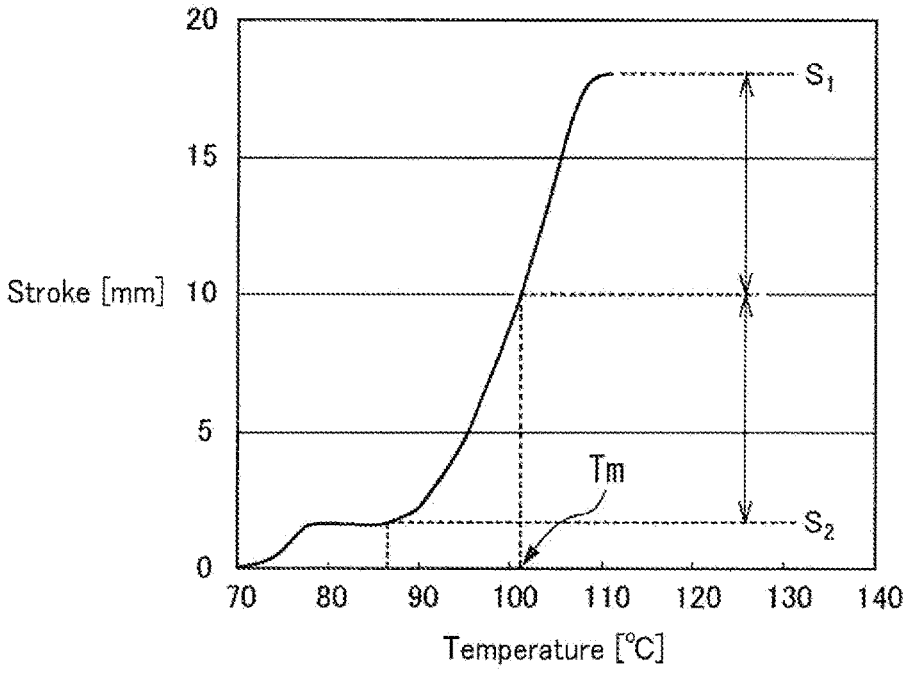
FIG. 5 illustrates a method of reading a softening point from an S-shaped curve.

Next, the following explains a method of reading Tm of the binder resin 11*a* from an S-shaped curve with reference mainly to FIG. 5. FIG. 5 is a graph of an example of the S-shaped curve.

The softening point Tm of the binder resin 11*a* can be measured by the method as explained below. A capillary rheometer (for example, CFT-500D, product of Shimadzu Corporation) may be used to measure the softening point Tm of the binder resins 11*a*. For example, the binder resin 11*a* (measurement sample) is placed in the capillary rheometer and the sample is caused to melt flow under specific conditions. As a result, an S-shaped curve of stroke (mm)/temperature (° C.) is obtained. Then, Tm of the binder resin 11*a* is read from the S-shaped curve obtained. In FIG. 5, $S_1$ denotes a maximum stroke value, and $S_2$ denotes a base line stroke value at low temperatures. Tm of the measurement sample is determined to be a temperature corresponding to a point on the S-shaped curve at which the stroke is equal to $(S_1+S_2)/2$.

The following continues explanation of the binder resin 11*a* shown in FIG. 1. The binder resin 11*a* is preferably a resin having a functional group such as an ester group, a hydroxyl group, an ether group, an acid group, a methyl group, or a carboxyl group in molecules thereof, and more preferably have a hydroxyl group and/or a carboxyl group. The cores 11 (binder resin 11*a*) having such a functional group as listed above readily react with the shell material (for example, methylol melamine) to be chemically bonded thereto. Such chemical bonding causes the cores 11 to be firmly attached to the shell layers 12.

The binder resin 11*a* is preferably a thermoplastic resin. Preferable examples of thermoplastic resins that can be used as the binder resin 11*a* include styrene-based resins, acrylic-based resins, styrene-acrylic-based resins, polyethylene-based resins, polypropylene-based resins, vinyl chloride-based resins, polyester resins, polyamide resins, urethane resins, polyvinyl alcohol-based resins, vinyl ether-based resins, N-vinyl-based resins, and styrene-butadiene based resins. Among the examples listed above, styrene-acrylic-based resins and polyester resins are preferable for improving colorant dispersibility in the toner, chargeability of the toner, and fixability of the toner on a recording medium.

(Styrene Acrylic-Based Resin)

The styrene-acrylic-based resin is a copolymer of a styrene-based monomer and an acrylic-based monomer.

Preferable examples of styrene-based monomers that can be used in preparation of the styrene-acrylic-based resin (binder resin 11*a*) include styrene, α-methylstyrene, p-hydroxystyrene, m-hydroxystyrene, vinyltoluene, α-chlorostyrene, o-chlorostyrene, m-chlorostyrene, p-chlorostyrene, and p-ethylstyrene.

Preferable examples of acrylic-based monomers that can be used in preparation of the styrene-acrylic-based resin (binder resin 11*a*) include (meth)acrylic acid, alkyl (meth) acrylates, and hydroxyalkyl (meth)acrylates. Preferable examples of alkyl esters of (meth)acrylic acid include methyl (meth)acrylate, ethyl (meth)acrylate, n-propyl (meth)acrylate, iso-propyl (meth)acrylate, n-butyl (meth) acrylate, iso-butyl (meth)acrylate, and 2-ethylhexyl (meth) acrylate. Preferable examples of hydroxyalkyl esters of (meth)acrylic acid include 2-hydroxyethyl (meth)acrylate, 3-hydroxypropyl (meth)acrylate, 2-hydroxypropyl (meth) acrylate, or 4-hydroxybutyl (meth)acrylate.

A hydroxyl group can be introduced into the styrene-acrylic-based resin by using a monomer having a hydroxyl group (for example, p-hydroxystyrene, m-hydroxystyrene, or hydroxyalkyl (meth)acrylate) during preparation of the styrene-acrylic-based resin. The hydroxyl value of the styrene-acrylic-based resin to be obtained can be adjusted by, for example, appropriately adjusting the amount of the monomer having a hydroxyl group.

A carboxyl group can be introduced into the styrene-acrylic-based resin by using (meth)acrylic acid (monomer) during preparation of the styrene-acrylic-based resin. The acid value of the styrene-acrylic-based resin to be obtained can be adjusted by, for example, appropriately adjusting the amount of (meth)acrylic acid that is used in preparation of the styrene-acrylic-based resin.

When the binder resin 11*a* is a styrene acrylic-based resin, the styrene acrylic-based resin preferably has a number average molecular weight (Mn) of at least 2,000 and no greater than 3,000 to improve the strength of the cores 11 and the fixability of the toner. The styrene-acrylic-based resin preferably has a molecular weight distribution (i.e., a ratio Mw/Mn of the mass average molecular weight (Mw) relative to the number average molecular weight (Mn)) of at least 10 and no greater than 20. Mn and Mw of the binder resin 11*a* can be measured by using gel permeation chromatography.

(Polyester Resin)

The polyester resin that can be used as the binder resin 11*a* is obtained through condensation polymerization or condensation copolymerization of a di-, tri-, or higher-hydric alcohol and a di-, tri-, or higher-basic carboxylic acid.

When the binder resin 11*a* is a polyester resin, preferable examples of alcohols that can be used in preparation of the polyester resin include diols, bisphenols, and tri- or higher hydric alcohols as listed below.

Preferable examples of diols that can be used in preparation of the polyester resin include ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, and polytetramethylene glycol.

Preferable examples of bisphenols that can be used in preparation of the polyester resin include bisphenol A, hydrogenated bisphenol A, polyoxyethylenated bisphenol A, and polyoxypropylenated bisphenol A.

Preferable examples of tri- or higher hydric alcohols that can be used in preparation of the polyester resin include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

When the binder resin 11*a* is a polyester resin, preferable examples of carboxylic acids that can be used in preparation of the polyester resin include di-, tri-, or higher-basic carboxylic acid.

Preferable examples of di-basic carboxylic acids that can be used in preparation of the polyester resin include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, succinic acid, alkyl succinic acids (more specifically, n-butyl succinic acid, isobutylsuccinic acid, n-octylsuccinic acid, n-dodecylsuccinic acid, and isododecylsuccinic acid), and alkenyl succinic acids (more specifically, n-butenyl succinic acid, isobutenylsuccinic acid, n-octenylsuccinic acid, n-dodecenylsuccinic acid, and isododecenylsuccinic acid).

Preferable examples of tri- or higher-basic carboxylic acids that can be used in preparation of the polyester resin include 1,2,4-benzenetricarboxylic acid (trimellitic acid), 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl) methane, 1,2,7,8-octanetetracarboxylic acid, pyromellitic acid, and EMPOL trimer acid.

An ester-forming derivative (an acid halide, an acid anhydride, or a lower alkyl ester) of any of the above-listed di-, tri-, or higher-basic carboxylic acid may be used. Herein the term "lower alkyl" refers to an alkyl group having one to six carbon atoms.

Each of the acid value and the hydroxyl value of the polyester resin can be adjusted by appropriately adjusting the amount of the di-, tri-, or higher-hydric alcohol and the amount of the di-, tri-, or higher-basic carboxylic acid used during preparation of the polyester resin. Note that increasing the molecular weight of the polyester resin tends to decrease the acid value and the hydroxyl value of the polyester resin.

When the binder resin 11*a* is a polyester resin, the polyester resin preferably has a number average molecular weight (Mn) of at least 1,200 and no greater than 2,000 in order to improve the strength of the cores 11 and the fixability of the toner. The polyester resin preferably has a molecular weight distribution (i.e., a ratio Mw/Mn of the mass average molecular weight (Mw) relative to the number average molecular weight (Mn)) of at least 9 and no greater than 20. Mn and Mw of the binder resin 11*a* can be measured by using gel permeation chromatography.

[Colorant (Cores)]

The cores 11 may for example contain a colorant as an internal additive 11*b*. The colorant can be a commonly known pigment or dye selected to match a color of the toner. The amount of the colorant is preferably at least 1 part by mass and no greater than 20 parts by mass relative to 100 parts by mass of the binder resin 11*a*, and more preferably at least 3 parts by mass and no greater than 10 parts by mass.

(Black Colorant)

The cores 11 may contain a black colorant. The black colorant may for example be carbon black. The black colorant may be a colorant that has been adjusted to a black color by combining colorants such as a yellow colorant, a magenta colorant, and a cyan colorant.

(Non-Black Colorants)

The cores 11 may contain a non-black colorant such as a yellow colorant, a magenta colorant, or a cyan colorant.

Preferable examples of the yellow colorant include condensed azo compounds, isoindolinone compounds, anthraquinone compounds, azo metal complexes, methine compounds, and arylamide compounds. Preferable examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, and 194), Naphthol Yellow S, Hansa Yellow G, and C.I. Vat Yellow.

Preferable examples of the magenta colorant include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Preferable examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, and 254).

Preferable examples of the cyan colorant include copper phthalocyanine compounds, copper phthalocyanine derivatives, anthraquinone compounds, and basic dye lake compounds. Preferable examples of cyan colorants include C.I. Pigment Blue (1, 7, 15, 15:1, 15:2, 15:3, 15:4, 60, 62, and 66), Phthalocyanine Blue, C.I. Vat Blue, and C.I. Acid Blue.

[Releasing Agent (Cores)]

The cores 11 may contain a releasing agent as an internal additive 11*b*. The releasing agent is used, for example, to improve the fixability or the offset resistance of the toner. To improve the fixability or the offset resistance of the toner, the amount of the releasing agent is preferably at least 1 part by mass and no greater than 30 parts by mass relative to 100 parts by mass of the binder resin 11*a*, and more preferably at least 5 parts by mass and no greater than 20 parts by mass.

Preferable examples of the releasing agent include: aliphatic hydrocarbon-based waxes, such as low molecular weight polyethylene, low molecular weight polypropylene, polyolefin copolymer, polyolefin wax, microcrystalline wax, paraffin wax, and Fischer-Tropsch wax; oxides of aliphatic hydrocarbon-based waxes, such as polyethylene oxide wax and block copolymer thereof; plant waxes, such as candelilla wax, carnauba wax, Japan wax, jojoba wax, and rice wax; animal waxes, such as beeswax, lanolin, and spermaceti; mineral waxes, such as ozocerite, ceresin, and petrolatum; waxes having a fatty acid ester as major component, such as montanic acid ester wax, and castor wax; and waxes in which a part or all of a fatty acid ester has been deoxidized, such as deoxidized carnauba wax.

[Shell Layers]

The shell layers 12 may essentially consist of a thermosetting resin, may essentially consist of a thermoplastic resin, or may contain both a thermosetting resin and a thermoplastic resin. To improve the high-temperature preservability of the toner, the shell layers 12 preferably contain a thermosetting resin, and more preferably consist essentially of a thermosetting resin. To improve the high-temperature preservability of the toner, at least 80% by mass of the resin contained in the shell layers 12 is the thermosetting resin, more preferably at least 90% by mass of the resin is the thermosetting resin, and particularly preferably 100% by mass of the resin is the thermosetting resin.

To enhance the strength and cationic nature of the shell layers 12, the shell layers 12 preferably contain a nitrogen-containing resin, and more preferably contain at least one resin selected from the group consisting of a melamine resin, a urea resin, and a glyoxal resin. When the shell layers 12 contain nitrogen atoms, the shell layers 12 are readily charged to a positive charge. To enhance the cationic nature, the content of the nitrogen atoms in the shell layers 12 is preferably at least 10% by mass.

Preferable examples of the thermosetting resin contained in the shell layers 12 include melamine resins, urea resins, sulfonamide resins, glyoxal resins, guanamine resins, aniline resins, polyimide resins, and derivatives of any of the aforementioned resins. A polyimide resin contains nitrogen atoms within the molecular framework thereof. Therefore, when the shell layers 12 contain a polyimide resin, the shell layers 12 tend to be strongly cationic. Preferable examples of polyimide resins that can be contained in the shell layers 12 include maleimide-based polymers and bismaleimide-based polymers (for example, amino-bismaleimide polymers and bismaleimide triazine polymers).

In particular, the thermosetting resin contained in the shell layers 12 is preferably a resin produced through polycondensation of an aldehyde (for example, formaldehyde) and a compound having an amino group. Note that a melamine resin is a polycondensate of melamine and formaldehyde. A urea resin is a polycondensate of urea and formaldehyde. A glyoxal resin is a polycondensate of formaldehyde and a reaction product of glyoxal and urea.

The thermosetting resin contained in the shell layers 12 can be prepared by using at least one monomer (shell material) selected from the group consisting of methylol melamine, melamine, methylol urea (for example, dimethylol dihydroxy ethylene urea), urea, benzoguanamine, acetoguanamine, and spiroguanamine. The shell material is preferably a material that dissolves or disperses in water. In addition, a hardening agent or a reaction accelerator may be used in formation of the shell layers 12.

The shell layers 12 preferably have a thickness of at least 1 nm and no greater than 20 nm, and more preferably at least 1 nm and no greater than 10 nm.

With a thickness of no greater than 20 nm, the shell layers 12 can easily rupture during fixing of the toner on a recording medium through application of heat and pressure. This ensures the toner to be fixed to a recording medium at low temperatures. With a thickness of no greater than 20 nm, in addition, the shell layers 12 are restricted from being excessively charged. Consequently, the use of the toner can ensure high-quality images to be formed.

On the other hand, with a thickness of at least 1 nm, the shell layers 12 have an improved strength and may not rupture upon impact or the like during transportation of the toner.

The thickness of the shell layers 12 can be measured by analyzing a transmission electron microscopy (TEM) image of a cross-section of a toner particle 10 by using commercially available image-analyzing software (for example, WinROOF, product of Mitani Corporation). When the shell layer 12 of one toner particle is not uniform in thickness, the thickness of the shell layer 12 is measured at each of four, substantially equally spaced locations (more specifically, at each of four locations of the shell layer crossed by two straight lines drawn to intersect at right angles at approximately the center of the cross-section). An arithmetic mean of the four measured values of the shell layer thickness is taken as an evaluation value (the thickness of the shell layer 12) for the toner particle.

When the shell layers 12 are cationic (positively chargeable), the presence of a positively chargeable charge control agent in the shell layers 12 can enhance the cationic nature of the shell layers 12.

[External Additive]

The external additive 13 is used, for example, to improve the fluidity or the handleability of the toner. To improve the fluidity or the handleability of the toner, the amount of the external additive 13 is preferably at least 0.5 parts by mass and no greater than 10 parts by mass relative to 100 parts by mass of the toner mother particles, and more preferably at least 2 parts by mass and no greater than 5 parts by mass.

Preferable examples of the external additive 13 include silica particles and particles of a metal oxide (for example, alumina, titanium oxide, magnesium oxide, zinc oxide, strontium titanate, or barium titanate).

In order to improve the fluidity or handleability of the toner, the external additive 13 preferably has a number average primary particle diameter of at least 0.01 μm and no greater than 1.0 μm.

[Method of Manufacturing Toner]

Next, the following explains a method of manufacturing a toner according to the present embodiment. In the method of manufacturing a toner according to the present embodiment, the cores 11 are formed. Subsequently, a preliminary external additive is caused to adhere to the surface of the cores 11. Subsequently, the shell layers 12 are formed on the surface of the cores 11. Subsequently, the preliminary external additive is removed from the surface of the cores 11. If necessary, the external additive 13 may subsequently be caused to adhere to the surface of the shell layers 12. In the causing adhesion of the preliminary external additive, the preliminary external additive having a number average primary particle diameter of at least 200 nm and no greater than 600 nm is caused to adhere to the cores 11 in an amount of at least 2.0 parts by mass and no greater than 9.0 parts by mass relative to 100 parts by mass of the cores 11. The above enables the surface potential distribution (in particular, the uniformity of the surface potential) of each toner particle 10 to be appropriately adjusted.

In the above-described method of manufacturing a toner, it is preferable that particles of the preliminary external additive are hydrophobic at least at their surfaces, and that the shell layers 12 are hydrophilic. With this method, preferable cavities 12*a* can be formed in the shell layers 12.

Particles used to prepare the preliminary external additive are preferably hydrophobic particles or particles each having a surface that can be treated to be hydrophobic. When non-hydrophobic particles are used to prepare the preliminary external additive, it is preferable to treat the surface of the particles to be hydrophobic. For example, the surface of the particles can be made hydrophobic by coating with silicone oil. The particles used for preparing the preliminary external additive may be organic particles or inorganic particles.

As the preliminary external additive, polystyrene particles are preferable. Polystyrene particles are prepared through, for example, suspension polymerization or emulsion polymerization of styrene monomer. The diameters of the polystyrene particles can be adjusted by changing the additive amount of the styrene monomer.

In the formation of the shell layers 12, the cores 11 and a shell material are put into a liquid, for example. Subsequently, the liquid maintained at a predetermined temperature is stirred to cause the shell material to polymerize on the surface of the cores 11. Through the above, the shell layers 12 are formed on the surface of the cores 11.

The method of forming the shell layers 12 preferably enables adjusting the number average particle diameter and the particle diameter distribution of the toner to fall within a desired range. Preferable examples of the method of forming the shell layers 12 include in-situ polymerization, in-liquid curing, and coacervation, among which the in-situ polymerization is more preferable.

A preferable shell material is one that is readily formed into films on the surface of the cores 11 and that facilitates control of the toner aggregation. Preferable examples of the shell material include raw materials (for example, prepolymer or monomer) of melamine-based resins, urea-based resins (for example, urea-resorcin-based resins), urethane-based resins, amide-based resins, olefin-based resins, and gelatin-gum arabic resins. In particular, the raw materials of the melamine-based resins or urea-based resins (for example, urea-resorcin-based resins) are all low in water absorbability and excellent in storage stability. The use of a shell material having low water absorbability can restrict aggregation of the toner (adhesion of the toner particles). In addition, the use of such a shell material reduces change in the average particle diameter and the particle diameter distribution of the toner. In addition, the use of such a shell material can restrict aggregation of the toner during the storage.

A methylolated product, such as methylol melamine (precursor produced through addition reaction of melamine and formaldehyde) or methylol urea (precursor produced through addition reaction of urea and formaldehyde). The methylolated product is readily formed into films on the surface of the cores 11.

A preferable shell material is a material that disperses in water. The method of manufacturing a toner according to the present embodiment involves resinifying the shell material dispersed in an aqueous medium on the surface of the cores 11. In view of this, the use of a shell material having a high affinity for water is preferable. Such a shell material readily disperses in an aqueous medium.

Formation of the shell layers 12 (film formation) is preferably carried out in a liquid (solvent) that dissolves the shell material (for example, a methylolated product). Preferable examples of the solvent include water, methanol, and ethanol. To accelerate the formation of the shell layers 12 (film formation), the liquid temperature for forming methylol melamine or methylol urea into films are preferably at least 40° C. and no greater than 80° C. and more preferably at least 55° C. and no greater than 70° C.

To ensure the shell layers 12 to have a uniform thickness, it is preferable to disperse the cores 11 uniformly in the solvent. In order to improve the dispersibility of the cores 11, a dispersant may be added to the solvent. The amount of the dispersant is preferably no greater than 75 parts by mass relative to 100 parts by mass of the cores 11.

Examples of the dispersant include sodium polyacrylate, polyparavinyl phenol, partially saponified polyvinyl acetate, isoprene sulfonic acid, polyether, isobutylene-maleic anhydride copolymer, sodium polyaspartate, starch, gum arabic, polyvinylpyrrolidone, and sodium lignosulfonate. The dispersants listed above may be used alone or in combination of two or more.

Note that the above-described method of manufacturing a toner may be altered freely in accordance with desired configuration and characteristics of the toner. For example, the process of adding the cores 11 into a solvent may be performed either before or after the process of dissolving the shell material in the solvent. Alternatively, the cores 11 may be added to the solvent together with the shell material. In addition, the shell material may be added to the solvent all at once or in portions. In addition, the toner may be sifted after the external addition process. Also, non-essential processes may be omitted. When no external additive is caused to adhere to the surface of the toner mother particles (when the external addition process is omitted), the toner mother particles correspond to the toner particles. The material for forming the cores 11 (herein referred to as a core material) and the shell material are not limited to the specific compounds mentioned above (such as monomer or the like for forming a resin). For example, a derivative of any of the compounds mentioned above may be used as the core material or the shell material if necessary. Preferably, a large number of toner particles 10 are formed simultaneously in order to manufacture the toner efficiently.

Examples

The following explains Examples of the present disclosure. Table 1 shows toners A1-A4, toners B1-B4, toners C1-C4, toners D1-D4, toners E1-E4, toners F1-F4, toner G, and toner H (each of which is a toner for developing an electrostatic charge image).

TABLE 1

| Toner | Core (100 Parts by Mass) | Shell Layer | Preliminary External Additive Type | Preliminary External Additive Additive Amount (Parts by Mass) |
|---|---|---|---|---|
| Toner A1 | Core A | Shell Layer A | Particle A | 2.0 |
| Toner A2 | | | (200 nm) | 3.0 |
| Toner A3 | | | | 4.0 |
| Toner A4 | | | | 5.0 |
| Toner B1 | | | Particle B | 4.0 |
| Toner B2 | | | (400 nm) | 5.0 |
| Toner B3 | | | | 6.0 |
| Toner B4 | | | | 7.0 |
| Toner C1 | | | Particle C | 6.0 |
| Toner C2 | | | (600 nm) | 7.0 |
| Toner C3 | | | | 8.0 |
| Toner C4 | | | | 9.0 |
| Toner D1 | Core B | Shell Layer A | Particle B | 4.0 |
| Toner D2 | | | (400 nm) | 5.0 |
| Toner D3 | | | | 6.0 |
| Toner D4 | | | | 7.0 |
| Toner E1 | Core A | Shell Layer B | Particle B | 4.0 |
| Toner E2 | | | (400 nm) | 5.0 |
| Toner E3 | | | | 6.0 |
| Toner E4 | | | | 7.0 |
| Toner F1 | | Shell Layer C | Particle B | 4.0 |
| Toner F2 | | | (400 nm) | 5.0 |
| Toner F3 | | | | 6.0 |
| Toner F4 | | | | 7.0 |
| Toner G | Core A | Shell Layer A | None | — |
| Toner H | Core A | None | None | — |

The following sequentially explains, in order, a manufacturing method, an evaluation method, and evaluation results of the toners A1-H. Note that each evaluation result (value indicating shape, physical properties, or the like) for a powder (for example, toner cores, preliminary external additive, external additive, toner mother particle, or toner) is the number average of values measured with respect to an appropriate number of particles unless otherwise stated. In addition, for an evaluation associated with introduction of error, a sufficient number of values for reducing the error to a negligible level are measured, and the arithmetic mean of the thus measured values is used as an evaluation value. Note that the particle diameter of a powder is an equivalent circle diameter of a primary particle (diameter of a circle with equivalent projected area as the particle) unless otherwise stated.

[Core Preparation]

The following explains a method of preparing cores (cores A and B) used for manufacturing the toners A1-H.

(Method of Preparing Cores A)

To prepare the cores A, 100 parts by mass of a binder resin (polyester resin), 5 parts by mass of a releasing agent, and 5 parts by mass of a colorant were mixed by using a mixer (FM mixer FM-10B, product of Nippon Coke & Engineering Co., Ltd.).

The binder resin (polyester resin) was TUFTONE (registered Japanese trademark) NE-410 produced by Kao Corporation. The colorant was REGAL (registered Japanese trademark) 330R (carbon black) produced by Cabot Corporation. The releasing agent was VISCOL (registered Japanese trademark) 660P (polypropylene wax) produced by Sanyo Chemical Industries, Ltd.

Subsequently, the resultant mixture was melt-knead by using a two-screw extruder (PCM-30, product of Ikegai Corp.). Then, the resultant melt-knead was rolled and cooled.

Next, the melt-knead was roughly pulverized by using a mechanical pulverizer (Rotoplex (registered Japanese trademark) 16/8, product of Hosokawa Micron Corporation). The roughly pulverized product was further pulverized into fine particles by using a jet mill (Model-I Super Sonic Jet Mill, product of Nippon Pneumatic Mfg.). Subsequently, the fine particles were classified by using a classifying apparatus (Elbow-Jet EJ-LABO, product of Nittetsu Mining Co., Ltd.). Through the classification, the cores A having a median diameter (volume distribution standard) of 6.5 μm were obtained. The obtained cores A were anionic.

(Method of Preparing Cores B)

The cores B were prepared by the same method as the cores A except that XPE258 produced by Mitsui Chemicals, Inc. was used instead of TUFTONE (registered Japanese trademark) NE-410.

[Preliminary External Addition]

Figure 6A:
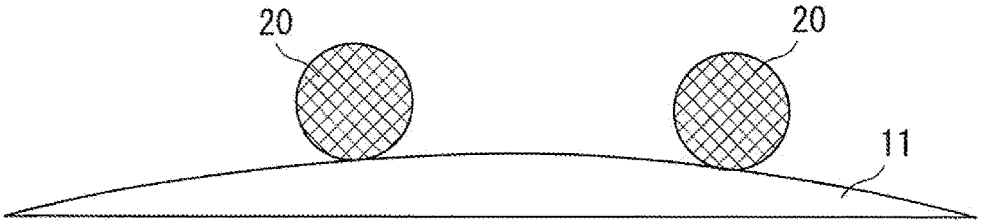
FIG. 6A illustrates a preliminary external addition process involved in a method of manufacturing a toner according to the present disclosure.
Figure 6B:
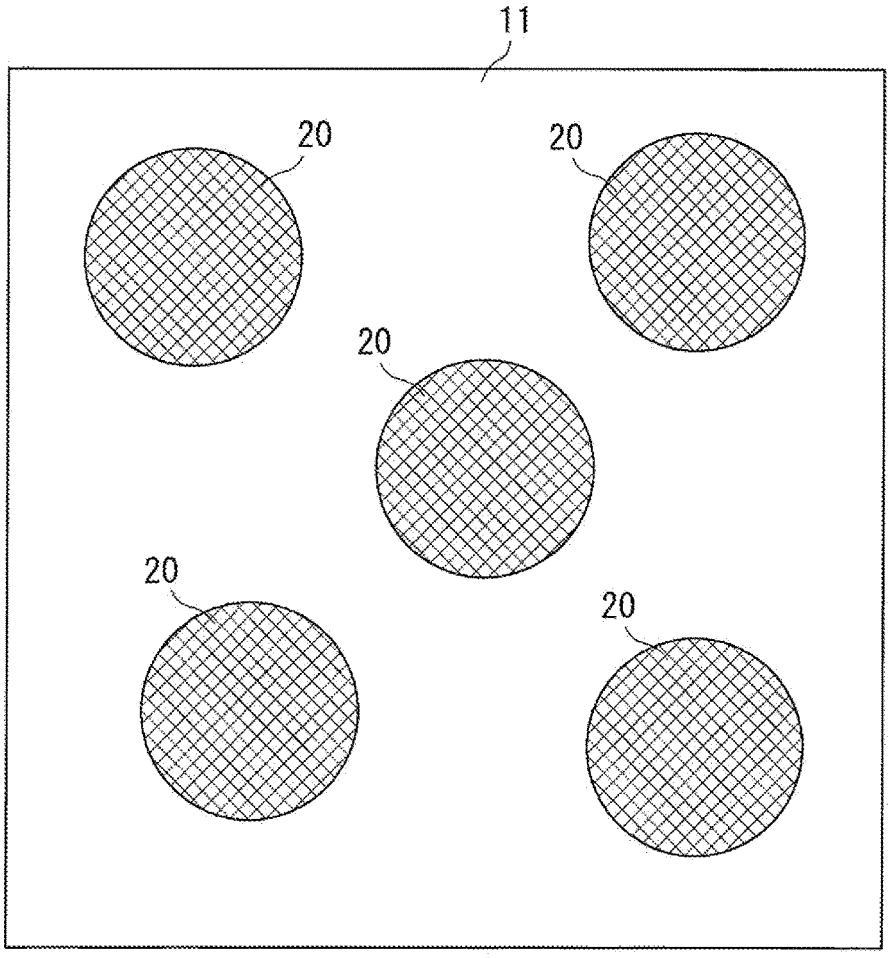
FIG. 6B illustrates the preliminary external addition process involved in the method of manufacturing a toner according to the present disclosure.

The cores for the toners A1-H (cores A or B) were prepared through the above processes. Subsequently, a preliminary external additive was caused to adhere to the surface of the cores. With reference to FIGS. 6A and 6B, the following explains a method of causing a preliminary external additive 20 (particles A, B, or C) to adhere to the surface of the cores 11. FIG. 6A is a cross-sectional view showing part of the core 11 having particles of the preliminary external additive on its surface. FIG. 6B is a plan view showing part of the core 11 having particles of the preliminary external additive on its surface.

In the process of the preliminary external addition, the cores and the preliminary external additive were mixed for 5 minutes by a mixer (FM mixer FM-10B, product of Nippon Coke & Engineering Co., Ltd.) at a rotational speed of 3,500 rpm. Through the above, particles of the preliminary external additive 20 were caused to adhere to the surface of the core 11 as shown in FIGS. 6A and 6B. Note that substantially all particles of the preliminary external additive added adhered to the surface of the cores.

The particles A, B, and C used as the preliminary external additive were fine particles of polystyrene (organic particles). The particles of the preliminary external additive (particles A, B, and C) each had a hydrophobic surface. The number average primary particle diameter of the cores A was 200 nm. The number average primary particle diameter of the cores B was 400 nm. The number average primary particle diameter of the cores C was 600 nm. The particle diameter of each particle was measured by capturing an image of the particle by using an electron microscope and then analyzing the captured image.

(Method of Preparing Preliminary External Additive)

The particles A, particles B, and particles C were prepared by the following method.

A four-necked flask was charged with a styrene monomer produced by Wako Pure Chemical Industries, Ltd. and distilled water. Subsequently, nitrogen gas was introduced into the flask to produce a nitrogen atmosphere in the flask.

Subsequently, while the contents of the flask were heated, a polymerization initiator (potassium peroxodisulfate produced by Wako Pure Chemical Industries, Ltd.) dissolved in distilled water in advance was added to the flask until the total amount of the contents of the flask reached 500 mL. The amount of the polymerization initiator (potassium peroxodisulfate) added to the flask was $3.83\times10^{-4}$ mol. Then, the contents of the flask was raised to 70° C. and stirred at a rotational speed of 400 rpm, causing emulsion polymerization (synthesis of particles) at 70° C. for 24 hours. As a result, a dispersion containing fine particles of polystyrene was obtained.

Subsequently, the resultant dispersion was subjected to drying, dehydrating, and vacuum and reduced pressure drying to turn the synthesized particles (polystyrene fine particles) into a dried powder. As a result, the polystyrene fine particles (particles A, B, or C) were obtained.

In the preparation of the polystyrene fine particles, the number average primary particle diameter of the polystyrene fine particles can be adjusted by changing the additive amount of styrene monomer. For example, to prepare the particles A having a number average primary particle diameter of 200 nm, 0.02 mol of styrene monomer was added to the flask. To prepare the particles B having a number average primary particle diameter of 400 nm, 0.05 mol of styrene monomer was added to the flask. To prepare the particles C having a number average primary particle diameter of 600 nm, 0.09 mol of styrene monomer was added to the flask.

[Shell Layer Formation]

Figure 7A:
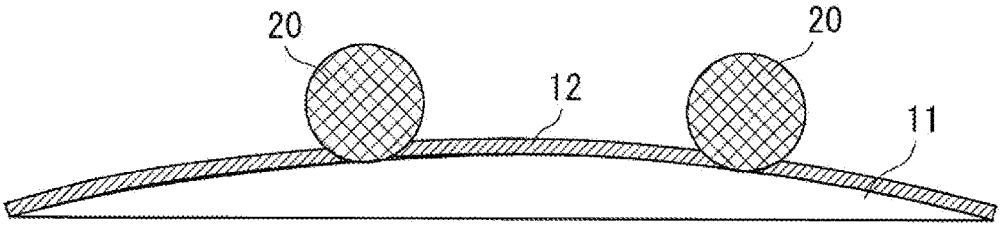
FIG. 7A illustrates a shell formation process involved in the method of manufacturing a toner according to the present disclosure.
Figure 7B:
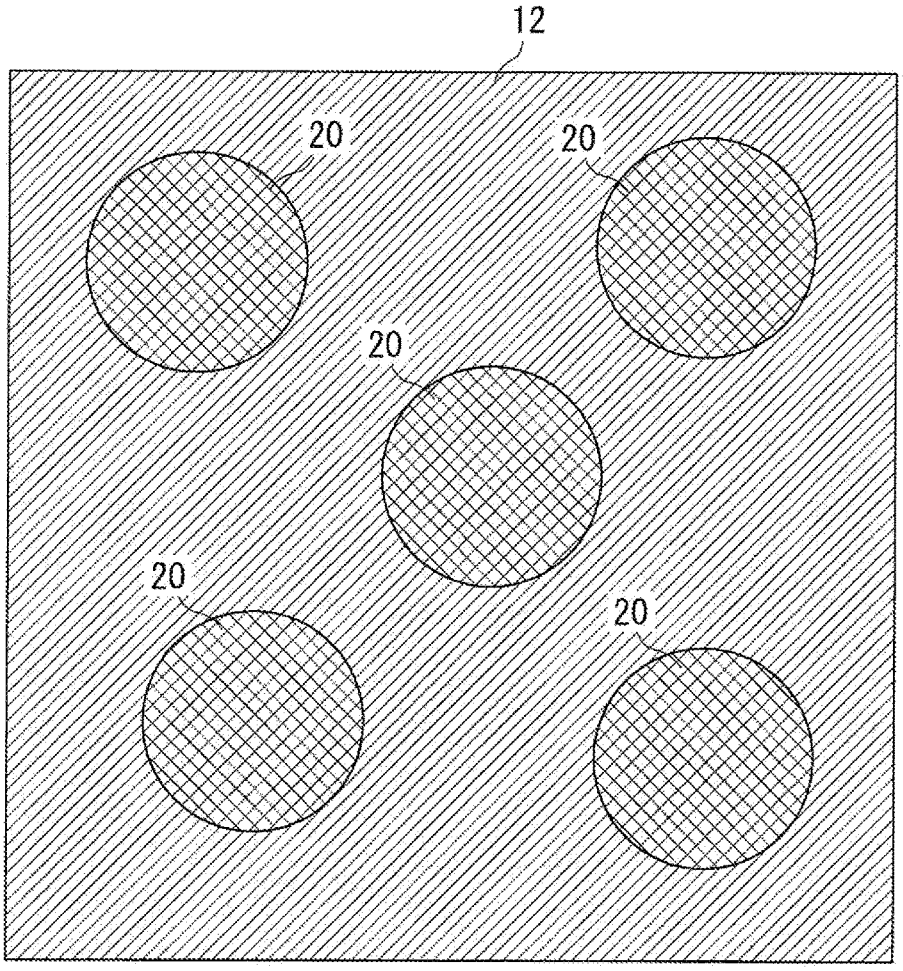
FIG. 7B illustrates the shell formation process involved in the method of manufacturing a toner according to the present disclosure.

In the manner described above, the preliminary external additive was added to the surface of the cores. Subsequently, a shell layer was formed on the surface of each core. With reference to FIGS. 7A and 7B in addition to FIGS. 6A and 6B, the following explains a method of forming shell layers 12 (shell layers A, B, or C) on the cores 11 (cores A or B) of the toners A1-H. FIG. 7A is a cross-sectional view showing part of the core 11 having a shell layer 12 on its surface. FIG. 7B is a plan view showing part of the core 11 having the shell layer 12 on its surface.

(Method of Forming Shell Layers A)

A three-necked flask having a capacity of 1 L and equipped with a thermometer and a stirring impeller was set up. The flask was then charged with 500 mL of ion exchanged water and 50 g of sodium polyacrylate (JURYMER (registered Japanese trademark AC-103, product of Toagosei Co., Ltd.). As a result, an aqueous solution of sodium polyacrylate was obtained in the flask.

Subsequently, 100 g of the cores to which the preliminary external additive was caused to adhere in the process described above (the cores 11 each in the state shown in FIGS. 6A and 6B) was added to the aqueous solution of sodium polyacrylate. Thereafter, the contents of the flask were sufficiently stirred at room temperature. As a result, the dispersion containing the cores was obtained in the flask.

Subsequently, the dispersion of the cores was filtered by using filter paper having a pore size of 3 μm. The filtration separated the cores from the filtrate. Subsequently, the cores were re-dispersed in ion exchanged water. Filtration and re-dispersion of the cores were repeated five times to wash the cores. Next, a suspension of 100 g of the cores in 500 mL of ion exchanged water was prepared in a flask.

Subsequently, 1 g of an aqueous solution of a urea-melamine-formaldehyde cocondensated resin (MIRBANE (registered Japanese trademark) resin SUM-100, product of Showa Denko K.K.; solid content concentration 80% by mass) was added to the flask, and the contents of the flask were stirred to dissolve the shell material in the suspension. Subsequently, the pH of the suspension in the flask was adjusted to 4 through addition of dilute hydrochloric acid to the flask.

Next, the suspension was transferred to a 1 L separable flask. Subsequently, while the contents of the flask were stirred with a stirring blade rotating at a rotational speed of 1,200 rpm, the internal temperature of the flask was raised up to 70° C. and maintained at 70° C. for one hour. Through the above, the cores and the shell material in the flask underwent polymerization reaction. As a result, cationic shell layers 12 were formed from a thermosetting resin on the surface of the cores 11 as shown in FIGS. 7A and 7B, yielding a dispersion containing toner mother particles. Thereafter, the dispersion was chilled rapidly to normal temperature (25° C.).

The thickness of the shell layers can be adjusted by changing a ratio of the additive amounts of the cores, the dispersant (for example, an aqueous solution of sodium polyacrylate), and the shell material. For example, the addition of 100 parts by mass of the cores, 50 parts by mass of the dispersant, and 1 part by mass of the shell material is assumed to result in shell layers measuring about 8 nm in thickness.

(Method of Forming Shell Layers B)

The shell layers B were formed by the same method as the shell layers A except that 50 g of partially saponified polyvinyl acetate (GOHSENOL (registered Japanese trademark) GM-14L, product of the Nippon Synthetic Chemical Industry Co., Ltd.) was used instead of JURYMER AC-103 and that 1 g of water-soluble methylol melamine (Nikaresin (registered Japanese trademark) S-260, product of Nippon Carbide Industries Co.) was used instead of MIRBANE resin SUM-100.

(Method of Forming Shell Layers C)

The shell layers C were formed by the same method as the shell layers A except that the dispersant (JURYMER AC-103) was not used and that 1 g of methylol melamine (Polyfix (registered Japanese trademark) KAM-7, product of Showa Denko K.K.; solid content concentration 80% by mass) was used instead of MIRBANE resin SUM-100.

[Solid-Liquid Separation]

Once the toner mother particles (toner cores and shell layers) were formed, the dispersion containing the toner mother particles were filtered (subjected to solid-liquid separation) to isolate the toner mother particles. The toner mother particles were subsequently re-dispersed in ion exchanged water. The washing and the filtration were repeated alternately to wash the toner mother particles. Subsequently, the toner mother particles were dried. As a result of repeated washing (dispersion and filtration), almost none of the dispersant (sodium polyacrylate) remained in or on the surface of the toner mother particles.

[Removal of Preliminary External Additive]

In the manner described above, the toner mother particles having the preliminary external additive adhering thereto was obtained. Thereafter, the preliminary external additive 20 was removed from the surface of the cores 11 shown in FIGS. 7A and 7B. With reference to FIGS. 7A and 7B, the following explains a process of removing the preliminary external additive.

The shell layers 12 are firmly bonded to the surface of the respective cores 11 through polymerization reaction. On the other hand, the strength of the bond between the preliminary external additive 20 and the surface of each core 11 is relatively weak. In addition, the shell layers 12 are hydrophilic, whereas the surface of each particle of the preliminary external additive 20 is hydrophobic. That is, the shell layers 12 and the preliminary external additive 20 have a low affinity for one another. This ensures easy removal of the preliminary external additive 20 even after the shell layers 12 are formed. For example, application of a slight external force can cause the preliminary external additive 20 to remove (displace) the preliminary external additive 20 from the surface of the cores 11.

More specifically, the preliminary external additive was removed from the surface of the cores by using a TTSP classifier (100TTSP, product of Hosokawa Micron Corporation) at the superfine particle removal (f/f classification) settings of rotating the upper and lower rotors at 10,000 rpm. As a result, cavities 12*a* were formed in the surface of each toner mother particle as shown in FIGS. 2A and 2B such that each cavity 12*a* extended through the shell layer 12 to expose the core 11. Each cavity 12*a* was formed at a location where a particle of the preliminary external additive 20 once resided was removed.

After the removable of the preliminary external additive in the manner described above, the surface of the cores were observed by using a scanning electron microscope (SEM) (JSM-7600F, a product of JEOL Ltd.). Through the observation, all the particles of the preliminary external additive were confirmed to have been removed.

[External Addition]

After the removal of the preliminary external additive (particles A, B, or C), an external additive was caused to adhere to the surface of the toner mother particles.

More specifically, 100 parts by mass of the toner mother particle, 1.0 part by mass of fine particles of conductive titanium oxide (EC-100, product of Titan Kogyo, Ltd.), and 0.7 parts by mass of fine particles of hydrophobic silica (RA-200H, product of Nippon Aerosil Co., Ltd.) were mixed for 5 minutes by using a mixer (FM mixer FM-10B, product of Nippon Coke & Engineering Co., Ltd.) at a rotational speed of 3,500 rpm. Through the mixing, the external additive 13 was caused to adhere to the surface of each shell layer 12 as shown in FIG. 1. As a result, a toner including a large number of toner particles (capsule toner for developing an electrostatic charge image) was obtained.

[Samples]

(Toners A1-A4)

To prepare each of the toners A1-A4, the cores A and the particles A were used and the shell layers A were formed. In the preparation of the toners A1, A2, A3, and A4, the particles A were added respectively in amounts of 2.0 parts by mass, 3.0 parts by mass, 4.0 parts by mass, and 5.0 parts by mass relative to 100 parts by mass of the cores (see Table 1).

(Toners B1-B4)

To prepare each of the toners B1-B4, the cores A and the particles B were used and the shell layers A were formed. In the preparation of the toners B1, B2, B3, and B4, the particles B were added respectively in amounts of 4.0 parts by mass, 5.0 parts by mass, 6.0 parts by mass, and 7.0 parts by mass relative to 100 parts by mass of the cores (see Table 1).

(Toners C1-C4)

To prepare each of the toners C1-C4, the cores A and the particles C were used and the shell layers A were formed. In the preparation of the toners C1, C2, C3, and C4, the particles C were added respectively in amounts of 6.0 parts by mass, 7.0 parts by mass, 8.0 parts by mass, and 9.0 parts by mass relative to 100 parts by mass of the cores (see Table 1).

(Toners D1-D4)

To prepare each of the toners D1-D4, the cores B and particles B were used and the shell layers A were formed. In the preparation of the toners D1, D2, D3, and D4, the particles B were added respectively in amounts of 4.0 parts by mass, 5.0 parts by mass, 6.0 parts by mass, and 7.0 parts by mass relative to 100 parts by mass of the cores (see Table 1).

(Toners E1-E4)

To prepare each of the toners E1-E4, the cores A and the particles B were used and the shell layers B were formed. In the preparation of the toners E1, E2, E3, and E4, the particles B were added respectively in amounts of 4.0 parts by mass, 5.0 parts by mass, 6.0 parts by mass, and 7.0 parts by mass relative to 100 parts by mass of the cores (see Table 1).

(Toners F1-F4)

To prepare each of the toners F1-F4, the cores A and the particles B were used and the shell layers C were formed. In the preparation of the toners F1, F2, F3, and F4, the particles B were added respectively in amounts of 4.0 parts by mass, 5.0 parts by mass, 6.0 parts by mass, and 7.0 parts by mass relative to 100 parts by mass of the cores (see Table 1).

(Toner G)

To prepare the toner G, the cores A were used and the shell layers A were formed. In the preparation of the toner G, no preliminary external additive was used (the process of preliminary external addition was not performed).

(Toner H)

To prepare the toner H, the cores A were used. In the preparation of the toner H, no preliminary external additive was used (the process of preliminary external addition was not performed). In addition, in the preparation of the toner H, no shell layers were formed.

[Evaluation Method]

The following explains the evaluation method of the samples (i.e., the toners A1-H).

(Presence of Shell Layers)

Toner particles of each sample (one of the toners A1-H) were pressed by using a pressure molding machine to prepare a flake with a thickness of 100 nm. In the case where pressing the toner particles was not possible, the toner particles were embedded in resin, followed by curing to obtain a hardened material. Then, a flake with a thickness of 100 nm was cut out from the hardened material by using an ultra-microtome (EM UC6, product of Leica Microsystems).

Subsequently, the obtained flake was fully dried on a metal screen of at least 100 mesh and no greater than 200 mesh. Then, a cross-sectional image of the flake (in particular, of the core surface) was captured by using a Schottky field emission scanning electron microscope (JSM-7600F, product of JEOL Ltd.) at an accelerating voltage of 30 kV.

As a result, a transmission electron microscopy (TEM) image was obtained at a predetermined magnification (×100,000). When necessary, the TEM image was observed in greater detail by using TEM-dedicated equipment.

Whether or not a shell layer was formed on the core was determined based on the obtained TEM image. When necessary, the presence of a shell layer was additionally confirmed by using a different method. For example, the presence of a shell layer was confirmed by conducting an alkaline immersion test. The presence of a shell layer was also confirmed by identifying the nitrogen contained in the shell layer by using electron energy loss spectrometer (EELS).

(Area Ratio)

The surface potential of a toner mother particle was measured (mapped) by using a scanning probe microscope (S-image, product of Hitachi High-Tech Science Corporation). Note that the toner mother particle subjected to the measurement was of a sample (one of the toners A1-H) before the external addition. First, the surface potential of a 1 $\mu m^2$ region (1 μm per side) located at the top surface (topmost portion) of the toner mother particle was measured.

Subsequently, an area ratio of a region R2 was obtained based on data about the surface potential measured on the 1 $\mu m^2$ region. More specifically, the minimum surface potential Vmin and the maximum surface potential Vmax within the 1 $\mu m^2$ region were determined Subsequently, the potential difference ΔV (=Vmax−Vmin) was calculated from the thus determined minimum surface potential Vmin and the maximum surface potential Vmax. Based on the thus calculated potential difference ΔV, an area ($\mu m^2$) of the region R2 (a region having the surface potential of at least Vmin+ΔV×0.4) within the 1 $\mu m^2$ region was determined. Then, the area ratio (%) of the region R2 within the 1 $\mu m^2$ region was calculated by the following formula.

$$\text{Area Ratio (\%) of Region } R2 = (\text{Area of Region } R2/1) \times 100$$

In the manner described above, the surface potential was measured for a total of ten 1 $\mu m^2$ regions (1 μm per side) of the toner mother particle to calculate the area ratios (%) of the respective regions R2. Then, the arithmetic mean (area ratio S) of all of the area ratios (10 measured values) of the regions R2 was calculated.

In the manner described above, the area ratio S was calculated for a total of 10 toner mother particles of the sample (one of the toners A1-H). The arithmetic mean of all of the thus calculated area rations S (10 measured values) was determined as an evaluation value (area ratio) of the corresponding toner. In the case where the measurement accuracy appeared insufficient for obtaining an accurate surface potential distribution of the toner particle, more than 10 measured values (area ratio of each region R2) were used to calculate the area ratio S of each toner particle.

(Chargeability)

A plastic bottle having a capacity of 20 mL was charged with 1 g of a sample (one of the toners A1-H) and 10 g of a ferrite carrier. Then, the contents of the bottle were stirred for 30 minutes by using a mixer (Turbula (registered Japanese trademark) mixer T2F, product of Willy A. Bachofen AG) at a rotational speed 100 rpm.

Subsequently, the resultant mixture was put into a metal vessel having a conductive 795-mesh screen at the bottom. Then, a portable charge measurement device that utilizes a "draw off" method (Q/m meter Model 210HS, product of TREK, INC.) was used to draw toner from the mixture. The electric charge of the toner was measured based on the amount of toner drawn and the readings of the Q/m meter.

A charge of at least 20 μC/g and no greater than 30 μC/g was evaluated as Very Good. A charge of at least 10 μC/g and less than 20 μC/g and a charge of greater than 30 μC/g and no greater than 40 μC/g were both evaluated as Good. A charge of less than 10 μC/g and a charge of greater than 40 μC/g were both evaluated as Poor.

(High-Temperature Preservability)

First, a plastic container having a capacity of 20 mL was charged with 3 g of a sample (one of the toners A1-H) and left to stand for 12 hours in an environment of a temperature of 23° C. and a humidity of 50% RH to adjust the humidity of the sample. Subsequently, the container was closed with a lid in the environment mentioned above. Subsequently, the hermetically sealed container was placed in a thermostatic chamber set at 60° C. and left to stand for 3 hours. Thereafter, the sample was left to stand at normal temperature for sufficient heat removal. Through the above, an evaluation toner was obtained. Subsequently, the mass of the resultant evaluation toner was measured.

Subsequently, by using a 150-mesh sieve placed in a powder tester, the evaluation toner was sifted for 30 seconds at a vibration level of 2. After the sifting, the mass of the toner remaining in the sieve was measured. The remaining percentage (% by mass) of the toner was calculated, in accordance with the following formula, from the mass of the toner before the sifting and the mass of the toner after the sifting (the mass of the toner remaining in the sieve after the sifting).

$$\text{Remaining Percentage (\% by Mass)} = (\text{Mass of Toner After Sifting}/\text{Mass of Toner Before Sifting}) \times 100$$

A remaining percentage of less than 10% by mass was evaluated as Very Good. A remaining percentage of at least 10% by mass and less than 40% by mass was evaluated as Good. A remaining percentage of at least 40% by mass was evaluated as Poor.

(Printing Durability Test)

Figure 8:
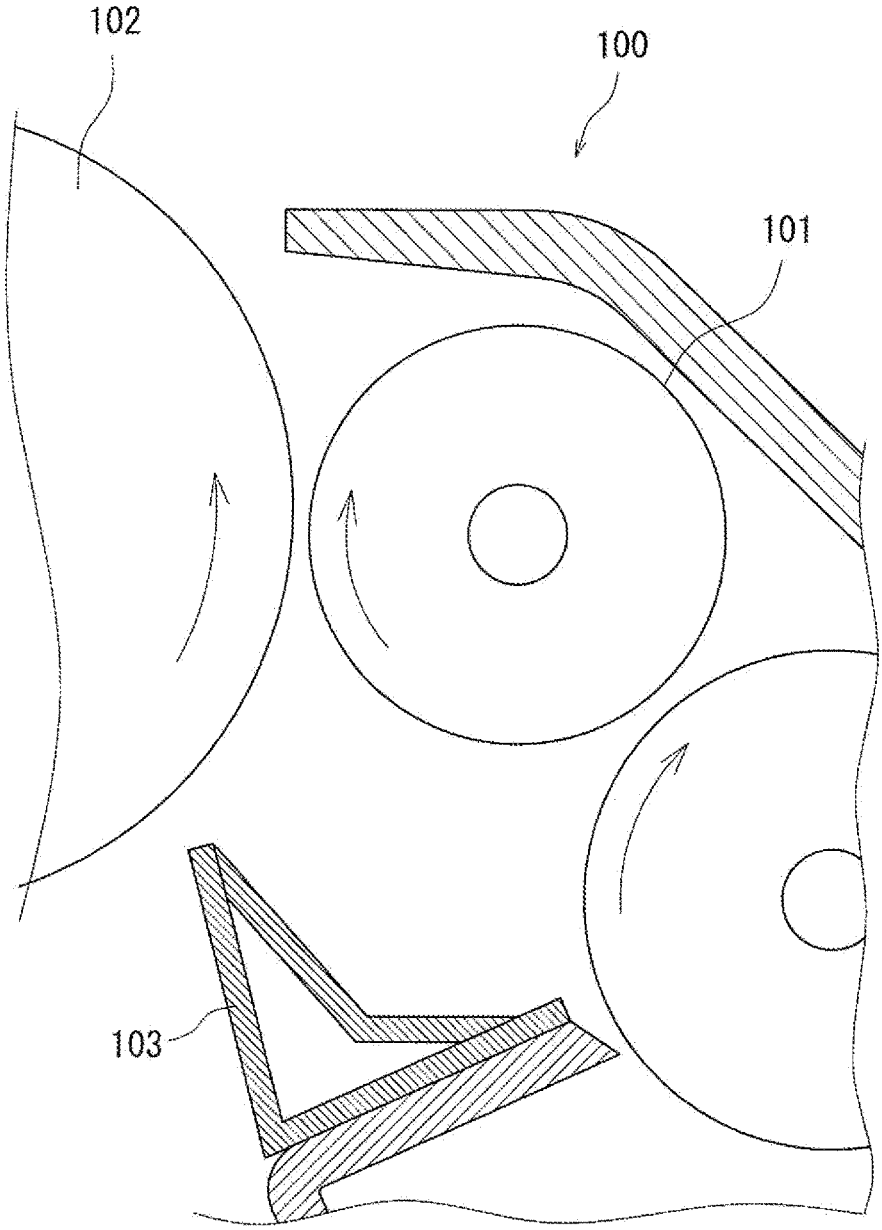
FIG. 8 illustrates a method of evaluating toner scattering.

A multifunction peripheral (TASKalfa5550ci, product of KYOCERA Document Solutions Inc.) was used as an evaluation apparatus. FIG. 8 shows a developing device 100 of the evaluation apparatus. As shown in FIG. 8, the developing device 100 includes a development roller 101 and a photosensitive drum 102. Disposed below the development roller 101 is a toner receiving section 103. Scattered toner accumulates on the toner receiving section 103.

A sample (one of the toners A1-H) was mixed with a developer carrier to prepare a two-component developer such that the concentration of the toner was 10% by mass. The developer carrier was prepared by spraying a solution containing 30 parts by mass of a silicone resin and 200 parts by mass of toluene relative to 1,000 parts by mass of Mn—Mg ferrite cores having a number average primary particle diameter of 35 μm, followed by heat treatment at 200° C. for 60 minutes.

The two-component developer thus prepared was put into the developing device of the evaluation apparatus and the sample (the corresponding one of the toners A1-H) was put into a toner container of the evaluation apparatus.

The following explains a method of measuring the image density (ID), the fogging density (FD), and the amount of toner scattering by using the evaluation apparatus. Note that the image density (ID) and the fogging density (FD) were each measured by using a spectrophotometer (SpectroEye, product of Sakata Inx Eng. Co., Ltd.). To measure the amount of toner scattering, a portable charge measurement device employing a "draw off" method (Q/m meter Model 210HS, product of TREK, INC.) was used to draw the toner accumulated on the toner receiving section 103 (FIG. 8) of the evaluation apparatus and to measure the mass of the toner drawn.

In the printing durability test, the image density (ID), the fogging density (FD), and the amount of toner scattering were measured each time after initial printing, intermittent printing, and continuous printing.

In the printing durability test regarding the initial image, the evaluation apparatus was operated to print an evaluation image (test chart No. 1) on evaluation paper under the standard ambient temperature and humidity conditions (temperature: 23° C., and humidity: 50% RH). Then, the image density (ID) of the solid portion of the evaluation image printed was measured. Thereafter, 50 prints of a sample image including a solid portion were continuously produced on paper (printing paper), and then 10 prints of a blank image was continuously produced on paper (evaluation paper). Then, the fogging density (FD) was measured on predetermined measurement locations of each of the 10 blank prints. The highest value among the measured fogging densities (FDs) was determined as an evaluation value. In addition, the amount of toner scattering (the amount of toner accumulated on the toner receiving section 103) was measured.

In the printing durability test regarding the intermittent printing, the evaluation apparatus was operated to intermittently produce 50,000 prints of a sample image having a low coverage rate (0.2%) on paper (printing paper) under the standard ambient temperature and humidity conditions (temperature: 23° C., and humidity: 50% RH). Then, the evaluation image (test chart No. 1) was printed on evaluation paper, and the image density (ID) of the solid portion of the evaluation image was measured. Thereafter, 50 prints of a sample image including a solid portion were continuously produced on paper (printing paper), and then 10 prints of a blank image was continuously produced on paper (evaluation paper). Then, the fogging density (FD) was measured on predetermined measurement locations of each of the 10 blank prints. The highest value among the measured fogging densities (FDs) was determined as an evaluation value. In addition, the amount of toner scattering (the amount of toner accumulated on the toner receiving section 103) was measured.

In the printing durability test regarding the continuous printing, the evaluation apparatus was operated to continuously produce 100,000 prints of a sample image having a high coverage rate (20%) on paper (printing paper) under the standard ambient temperature and humidity conditions (temperature: 23° C., and humidity: 50 RH). Then, the evaluation image (test chart No. 1) was printed on evaluation paper, and the image density (ID) of the solid portion of the evaluation image was measured. Thereafter, 50 prints of a sample image including a solid portion were continuously produced on paper (printing paper), and then 10 prints of a blank image was continuously produced on paper (evaluation paper). Then, the fogging density (FD) was measured at predetermined measurement locations on each of the 10 blank prints. The highest value among the measured fogging densities (FDs) was determined as an evaluation value. In addition, the amount of toner scattering (the amount of toner accumulated on the toner receiving section 103) was measured.

An image density (ID) of at least 1.30 was evaluated as Very Good, at least 1.00 and less than 1.30 was evaluated as Good, and less than 1.00 was evaluated as Poor.

A fogging density (FD) of less than 0.010 was evaluated as Very Good, at least 0.010 and less than 0.020 was evaluated as Good, and at least 0.020 was evaluated as Poor.

An amount of toner scattering of less than 0.20 g was evaluated as Very Good, and at least 0.20 g and less than 1.00 g was evaluated as Good, and at least 1.00 g was evaluated as Poor.

[Evaluation Results]

(Presence of Shell Layers)

Through the observation of TEM images of the respective samples, the toners A1-G were each confirmed to have shell layers formed on the surface of the cores. On the other hand, the toner H was conformed to have no shell layers. The shell layers of the toners A1-F4 were each provided with cavities. On the other hand, the shell layers of the toner G were without cavities.

(Area Ratio, Charge, High-Temperature Preservability of Toner)

Table 2 summarizes the evaluation results of the area ratio, the charge, the high-temperature preservability of each of the toners A1-H.

TABLE 2

| Toner | Area Ratio (%) | Charge (μC/g) | High-Temperature Preservability (60° C., 3 Hours) |
|---|---|---|---|
| Toner A1 | 88 | 35 | 8 |
| Toner A2 | 79 | 27 | 19 |
| Toner A3 | 71 | 15 | 34 |
| Toner B1 | 92 | 37 | 7 |
| Toner B2 | 84 | 29 | 14 |
| Toner B3 | 77 | 20 | 30 |
| Toner C1 | 87 | 34 | 10 |
| Toner C2 | 80 | 26 | 18 |
| Toner C3 | 72 | 16 | 35 |
| Toner D1 | 89 | 36 | 9 |
| Toner D2 | 82 | 29 | 15 |
| Toner D3 | 76 | 18 | 32 |
| Toner E1 | 91 | 38 | 5 |
| Toner E2 | 84 | 30 | 16 |
| Toner E3 | 76 | 15 | 29 |
| Toner F1 | 92 | 38 | 6 |
| Toner F2 | 84 | 29 | 14 |
| Toner F3 | 78 | 20 | 27 |
| Toner A4 | 64 | 9 | 43 |
| Toner B4 | 60 | 7 | 48 |
| Toner C4 | 55 | 6 | 51 |
| Toner D4 | 63 | 8 | 45 |
| Toner E4 | 59 | 8 | 48 |
| Toner F4 | 60 | 9 | 45 |
| Toner G | 99 | 52 | 3 |
| Toner H | 0 | — | 99 |

For each of the toners A1-A3, B1-B3, C1-C3, D1-D3, E1-E3, and F1-F3, the area ratio of the region R2 was at least 70% and no greater than 95%.

For each of the toners A4, B4, C4, D4, E4, F4, and H, the area ratio of the region R2 was less than 70% (more specifically, no greater than 64%).

For the toner G, the area ratio of the region R2 was greater than 95%.

Note that all of the toners resulted in the minimum surface potential Vmin of about 250 mV and the maximum surface potential Vmax of about 350 mV.

For each of the toners A2, B2, B3, C2, D2, E2, F2, and F3, the charge on the toner was at least 20 μC/g and no greater than 30 μC/g. For each of the toner A3, C3, D3, and E3, the charge on the toner was at least 10 μC/g and less than 20 μC/g. For each of the toners A1, B1, C1, D1, E1, and F1, the charge on the toner was greater than 30 μC/g and no greater than 40 μC/g. For each of the toners A4, B4, C4, D4, E4, and F4, the charge on the toner was less than 10 μC/g. For the toner U, the charge on the toner was greater than 40 μC/g. The charge on the toner H was not measurable.

For each of the toners A1, B1, D1, E1, F1, and G, the remaining percentage was less than 10% by mass. For each of the toners A2, A3, B2, B3, C1-C3, D2, D3, E2, E3, F2, and F3, the remaining percentage was at least 10% by mass and less than 40% by mass. For each of the toners A4, B4, C4, D4, E4, F4, and H, the remaining percentage was at least 40%.

(Printing Durability Test)

Table 3 summarizes the results of the printing durability tests on the toners A1-H.

TABLE 3

| | Printing Durability Test | | | | | | | |
|---|---|---|---|---|---|---|---|---|
| | | | After 50,000 Intermittent Printing of Low-Coverage Rate Image (0.2%) | | | After 100,000 Continuous Printing of High-Coverage Rate Image (20%) | | |
| | Initial Image | | | | Toner Scat- | | | Toner |
| Toner | ID | FD | ID | FD | tering | ID | FD | Scattering |
| Toner A1 | 1.20 | 0.005 | 1.10 | 0.003 | 0.05 | 1.25 | 0.007 | 0.16 |
| Toner A2 | 1.30 | 0.007 | 1.23 | 0.004 | 0.08 | 1.36 | 0.009 | 0.25 |
| Toner A3 | 1.41 | 0.009 | 1.35 | 0.007 | 0.10 | 1.44 | 0.011 | 0.40 |
| Toner B1 | 1.18 | 0.004 | 1.06 | 0.002 | 0.05 | 1.24 | 0.006 | 0.14 |
| Toner B2 | 1.27 | 0.006 | 1.21 | 0.002 | 0.06 | 1.35 | 0.008 | 0.20 |
| Toner B3 | 1.38 | 0.007 | 1.34 | 0.003 | 0.08 | 1.42 | 0.010 | 0.33 |
| Toner C1 | 1.21 | 0.005 | 1.12 | 0.003 | 0.05 | 1.26 | 0.007 | 0.16 |
| Toner C2 | 1.31 | 0.006 | 1.23 | 0.005 | 0.07 | 1.36 | 0.009 | 0.23 |
| Toner C3 | 1.41 | 0.008 | 1.34 | 0.007 | 0.09 | 1.41 | 0.011 | 0.36 |
| Toner D1 | 1.19 | 0.004 | 1.12 | 0.003 | 0.05 | 1.24 | 0.006 | 0.14 |
| Toner D2 | 1.27 | 0.006 | 1.25 | 0.004 | 0.08 | 1.34 | 0.008 | 0.23 |
| Toner D3 | 1.38 | 0.008 | 1.38 | 0.005 | 0.08 | 1.40 | 0.010 | 0.34 |
| Toner E1 | 1.18 | 0.004 | 1.08 | 0.003 | 0.05 | 1.24 | 0.007 | 0.15 |
| Toner E2 | 1.25 | 0.007 | 1.23 | 0.004 | 0.08 | 1.33 | 0.008 | 0.22 |
| Toner E3 | 1.40 | 0.009 | 1.32 | 0.006 | 0.09 | 1.41 | 0.010 | 0.35 |
| Toner F1 | 1.15 | 0.004 | 1.05 | 0.003 | 0.05 | 1.22 | 0.007 | 0.14 |
| Toner F2 | 1.28 | 0.007 | 1.20 | 0.003 | 0.08 | 1.34 | 0.008 | 0.23 |
| Toner F3 | 1.39 | 0.008 | 1.33 | 0.005 | 0.10 | 1.41 | 0.009 | 0.33 |
| Toner A4 | 1.46 | 0.011 | 1.36 | 0.008 | 0.08 | 1.52 | 0.027 | 1.50 |
| Toner B4 | 1.45 | 0.010 | 1.35 | 0.009 | 0.08 | 1.53 | 0.025 | 1.60 |
| Toner C4 | 1.48 | 0.011 | 1.38 | 0.009 | 0.09 | 1.60 | 0.040 | 2.00 |
| Toner D4 | 1.45 | 0.010 | 1.35 | 0.008 | 0.08 | 1.52 | 0.030 | 1.70 |
| Toner E4 | 1.45 | 0.009 | 1.36 | 0.009 | 0.07 | 1.54 | 0.026 | 1.55 |
| Toner F4 | 1.44 | 0.009 | 1.34 | 0.009 | 0.08 | 1.54 | 0.024 | 1.64 |
| Toner G | 1.05 | 0.002 | 0.53 | 0.002 | 0.01 | 1.20 | 0.005 | 0.05 |
| Toner H | 1.55 | 0.047 | 1.43 | 0.015 | 0.40 | 1.62 | 0.080 | 7.60 |

For each of the toners A1-F4 and H, the image densities (IDs) measured after the initial printing, intermittent printing, and continuous printing were all at least 1.00. For the toner G, the image density (ID) measured after the intermittent printing was less than 1.00.

For each of the toners A1-A3, B1-B3, C1-C3, D1-D3, E1-E3, F1-F3, and G the fogging densities (FDs) measured after the initial printing, intermittent printing, and continuous printing were all less than 0.020. Especially noted is that the toners A1, A2, B1, B2, C1, C2, D1, D2, E1, E2, F1-F3, and G all resulted in the fogging density (FD) of less than 0.010 each time after the initial printing, intermittent printing, and continuous printing.

For each of the toners A4, B4, C4, D4, E4, F4, and H, the fogging density (FD) measured after the continuous printing was at least 0.020. Especially, for the toner H, the initial fogging density (FD) was also at least 0.020.

For each of the toners A1-A3, B1-B3, C1-C3, D1-D3, E1-E3, F1-F3, and G the amounts of toner scattering measured after the intermittent printing and continuous printing were both less than 1.00 g. Especially noted is that the toners A1, B1, C1, D1, E1, F1, and G all resulted in the amount of toner scattering of less than 0.20 g each time after the intermittent printing and continuous printing. The toners A4, B4, C4, D4, E4, F4, and H all resulted in the amount of toner scattering of at least 1.00 g after the continuous printing.

As has been described above, the toners A1-A3, B1-B3, C1-C3, D1-D3, E1-E3, and F1-F3 (hereinafter, referred to as the toners of the present Examples) each satisfy the following with respect to a surface potential distribution, which is a distribution of surface potential as measured by a scanning probe microscope with respect to each of a plurality of 1 $\mu m^2$ regions of the toner particle in a state where no external additive adheres thereto and expressed in terms of an arithmetic mean of the surface potential values measured on the respective 1 $\mu m^2$ regions. That is, the surface potential was at least $V_{min}+\Delta V\times 0.4$ in at least 70% and no greater than 95% of each 1 $\mu m^2$ region. The surface potential of the toners of the present Examples was highly uniform. Note that the potential difference $\Delta V$ denotes the potential difference calculated by subtracting the minimum surface potential $V_{min}$ from the maximum surface potential $V_{max}$.

The toners of the present Examples all resulted in the charge of at least 10 μC/g and no greater than 40 μC/g. This demonstrates that the toners of the present Examples were excellent in chargeability.

In addition, the toners of the present Examples all resulted in the remaining percentage of less than 40% by mass. This demonstrates that the toners of the present Examples were excellent in high-temperature preservability.

In addition, the toners of the present Examples all resulted in the image density (ID) of at least 1.00 each time after the initial printing, intermittent printing, and continuous printing. In addition, the toners of the present Examples all resulted in the fogging density (FD) of less than 0.020 each time after the initial printing, intermittent printing, and continuous printing. In addition, the toners of the present Examples all resulted in toner scattering in an amount of less than 1.00 g. Consequently, when the toners of the present Examples were used in continuous printing of an image, no or little fogging was caused.

According to the method of manufacturing the toners of the present Examples, cores were formed first. Subsequently, a preliminary external additive was caused to adhere to the surface of the cores. Subsequently, shell layers were formed on the surface of the cores. Subsequently, the preliminary external additive was removed from the surface of the cores. Subsequently, an external additive was caused to adhere to the surface of the shell layers.

Each shell layer was thinner at a location where any of the cavities was present and therefore assumed to have a lower surface potential at such a location. This leads to the assumption that the surface potential distribution of each toner particle can be adjusted through controlling the number of cavities. The methods of manufacturing the toners of the present Examples each involved the use of a preliminary external additive. The use of a preliminary external additive allows the number of cavities (and thus the surface potential distribution of each toner particle) to be controlled easily.

In the methods of manufacturing the toners of the present Examples, the preliminary external additive used in the process of causing adhesion of the preliminary external additive was formed from particles having particle diameters of at least 200 nm and no greater than 600 nm and in an amount of at least 2.0 parts by mass and no greater than 9.0 parts by mass relative to 100 parts by mass of the cores. The above process is assumed to improve the uniformity of the surface potential distribution of each toner particle.

The present disclosure is not limited to Examples described above.

When toner particles of a toner satisfy that at least 70% and no greater than 95% of a 1 $\mu m^2$ region of each toner particle has a surface potential of at least $Vmin+\Delta V\times 0.4$, the toner is expected to have excellent chargeability (in particular, uniform surface potential).

When a method of manufacturing a toner involves: forming cores; causing a preliminary external additive to adhere to a surface of the cores; forming, after the preliminary external additive is caused to adhere, shell layers on the surface of the respective cores; and removing the preliminary external additive from the surface of the cores, the number of cavities (and thus the surface potential of each toner particle) can be readily controlled. In addition, in the adhesion of the preliminary external additive, the use of a preliminary external additive having a number average primary particle diameter of at least 200 nm and no greater than 600 nm in an amount of at least 2.0 parts by mass and no greater than 9.0 parts by mass can improve the uniformity in the distribution of the surface potential of each toner particle.

What is claimed is:

1. A method of manufacturing a toner, comprising:

forming cores;

causing a preliminary external additive to adhere to a surface of the cores;

forming, after the preliminary external additive is caused to adhere, shell layers on the surface of the respective cores in a solvent in which a material of the shell layers is dissolved; and removing, after the shell layers are formed, the preliminary external additive from the surface of the cores, wherein in the causing adhesion of the preliminary external additive, the preliminary external additive having a number average primary particle diameter of at least 200 nm and no greater than 600 nm is caused to adhere in an amount of at least 2.0 parts by mass and no greater than 9.0 parts by mass relative to 100 parts by mass of the cores.

2. A method of manufacturing a toner according to claim 1, further comprising causing, after the preliminary external additive is removed, an external additive to adhere to a surface of the shell layers.

3. A method of manufacturing a toner according to claim 1, wherein the preliminary external additive is formed from a plurality of particles each of which is hydrophobic at least at a surface, and the shell layers are hydrophilic.

4. A method of manufacturing a toner according to claim 1, wherein the shell layers contain a thermosetting resin.

5. A method of manufacturing a toner according to claim 1, wherein in the forming of the shell layers, the solvent contains water, methanol, or ethanol.

6. A method of manufacturing a toner according to claim 1, wherein in the forming of the shell layers, the solvent contains water.

7. A method of manufacturing a toner according to claim 1, wherein the forming of the shell layers includes mixing the cores to which the preliminary external additive adheres with the solvent.

8. A method of manufacturing a toner according to claim 1, wherein the material of the shell layers contains prepolymer or monomer.

9. A method of manufacturing a toner according to claim 8, wherein the monomer includes at least one selected from the group consisting of methylol melamine, melamine, methylol urea, urea, benzoguanamine, acetoguanamine, and spiroguanamine.

10. A method of manufacturing a toner according to claim 4, wherein the thermosetting resin contained in the shell layers includes at least one selected from the group of consisting of a melamine resin, an urea resin, a sulfonamide resin, a glyoxal resin, a guanamine resin, an aniline resin, and a polyimide resin.

11. A method of manufacturing a toner according to claim 1, wherein the shell layers have an average thickness of at least 1 nm and no greater than 20 nm.

12. A method of manufacturing a toner according to claim 1, wherein the preliminary external additive contains a polystyrene resin.

13. A method of manufacturing a toner according to claim 7, wherein the forming of the shell layers includes mixing the cores to which the preliminary external additive adheres, the solvent, and a dispersant together.

14. A method of manufacturing a toner according to claim 13, wherein the dispersant includes at least one selected from the group consisting of sodium polyacrylate, polyparavinyl phenol, partially saponified polyvinyl acetate, isoprene sulfonic acid, polyether, isobutylene-maleic anhydride copolymer, sodium polyaspartate, starch, gum arabic, polyvinylpyrrolidone, and sodium lignosulfonate.

15. A method of manufacturing a toner according to claim 1, wherein in the causing of a preliminary external additive to adhere to a surface of the cores, the preliminary external additive includes preliminary external additive particles, and in the forming of the shell layers, the shell layers has an average thickness smaller than an average diameter of the preliminary external additive particles.

16. A method of manufacturing a toner according to claim 1, wherein the removing of the preliminary external additive includes applying an eternal force to the cores to which the preliminary external additive adheres.

* * * * *